US007169069B1

(12) United States Patent
Dalton et al.

(10) Patent No.: US 7,169,069 B1
(45) Date of Patent: Jan. 30, 2007

(54) ADJUSTABLE HANDLE GRIP

(76) Inventors: Douglas Lloyd Dalton, 2744 Jim Hampton Ct., Las Vegas, NV (US) 89117; Morris Reisman, 10228 Amber Hue Ln., Las Vegas, NV (US) 89144

( * ) Notice: Subject to any disclaimer, the term of this patent is extended or adjusted under 35 U.S.C. 154(b) by 0 days.

(21) Appl. No.: 11/078,242

(22) Filed: Mar. 14, 2005

(51) Int. Cl.
*A63B 59/06* (2006.01)

(52) U.S. Cl. ..... 473/568

(58) Field of Classification Search ..... 473/564–568, 473/457, 519, 520, 549, 300–303; 81/489; 280/821; 74/551.9; 16/421, 430
See application file for complete search history.

(56) References Cited

U.S. PATENT DOCUMENTS

| | | | | |
|---|---|---|---|---|
| 2,091,458 A | | 8/1937 | Sleight | 273/72 |
| 3,469,839 A | | 9/1969 | Pietronuto et al. | 273/25 |
| 5,624,114 A | | 4/1997 | Kelsey | 473/520 |
| 5,980,397 A | * | 11/1999 | Hart et al. | 473/437 |
| 6,059,675 A | * | 5/2000 | Finn | 473/568 |
| 6,234,924 B1 | * | 5/2001 | Washburn, Jr. | 473/568 |
| 6,739,989 B2 | * | 5/2004 | Liberatore | 473/457 |
| 2001/0031674 A1 | * | 10/2001 | McGinnis | 473/451 |
| 2005/0277491 A1 | * | 12/2005 | Nolan | 473/451 |

FOREIGN PATENT DOCUMENTS

| | | | |
|---|---|---|---|
| JP | 02001259102 A | * | 9/2001 |
| JP | 02002346010 A | * | 12/2002 |

* cited by examiner

*Primary Examiner*—Mark S. Graham
(74) *Attorney, Agent, or Firm*—Edgar W. Averill, Jr.; Kenneth L. Green

(57) ABSTRACT

An adjustable collar for attachment around a handle such as the handle of a baseball bat. The adjustable collar has a rubber-like strip which has a strap affixed to its outer face. The strap extends past the rubber strip and has a ring at one end and a free end at the other end. The rubber-like strip is pressed against the place on the handle where it is desired to be attached and the free end is passed through the ring and is looped back toward the free end and affixed to the strap by a hook and loop fastener or other removable fastening structure.

3 Claims, 3 Drawing Sheets

ADJUSTABLE HANDLE GRIP

BACKGROUND OF THE INVENTION

The field of the invention is sporting goods and the invention relates more particularly to removable stops of the type which can be used to assist in modifying the configuration of the handle of a sporting implement such as a baseball bat or a golf club. The modification cushions the heel of the hand of the user and can be used also for tools, such as axes or brooms or the like.

When one is learning to play baseball, it is often useful for a coach to modify the player's grip to help in teaching the player an improved swinging technique. One such approach is known as choking up on the bat. This technique is especially useful in teaching children to swing a baseball bat which would otherwise be too long for them or to teach them to modify their conventional swing by their choking up or holding the bat further from the knob end of the bat.

Various devices have been created to help alleviate this problem. One such approach is shown in U.S. Pat. No. 5,624,114. This device is a series of resilient sleeves which may be placed over the end knob of the bat and its basic purpose is to provide a shock damper to reduce vibrations transmitted through the end knob of the bat to the user's hand. By providing more than one such damper, the damper can be used as a means for providing a reference for a batter to choke up in gripping the ball bat.

Another approach is shown in U.S. Pat. No. 3,469,839. The choke may be made from rubber and has a slit which allows it to be passed over the bat handle. A metal or plastic spring clip or O-ring is then inserted over one end of the knob and is held by a groove in the knob against the bat handle.

Another device which may be placed over the handle of a bat or other instrument is shown in U.S. Pat. No. 2,091,458. This device is a hand grip which has one or more finger stalls extending outwardly therefrom. The member is held to the handle by suction cups comprising dimples which are formed on the inner surface of the rubber ring.

While capable of assisting a young player to choke up at an accurate place on a baseball bat handle, these devices all have shortcomings. The device of U.S. Pat. No. 5,624,114 would clearly be very inexact when utilized as shown in FIG. 5 when acting as a reference point. The device would be readily compressed during the swing because of the nature of the construction of the device. The choke device shown in U.S. Pat. No. 3,469,839 is limited in its ability to grip different bats and if a bat is wet, or if the weather is cold, the use of a split ring and a clip would be likely to provide insufficient grip to create a meaningful stop for a young player who often does not grip the bat as tightly as an older player would.

Lastly, the hand grip of U.S. Pat. No. 2,091,458 may well be adequate as a finger grip for which it is designed, but an attempt to use such a design would be insufficient to hold the ring where desired when the baseball bat handle was smaller than that for which the ring was designed, or if the handle was wet or the weather cold.

BRIEF SUMMARY OF THE INVENTION

It is an object of the present invention to provide an adjustable collar which can be secured to any size handle of a device and provide a firm stop for the user.

The present invention is for an adjustable collar for removable attachment to a handle. The collar has a compressible elastomeric strip having an upper edge, a lower edge, a buckle end and a strap end, an inner face and an outer face and is affixed to a strap which is preferably inelastic.

The strap has an inner surface and an outer surface and is affixed to the outer face of the compressible elastomeric strip and the strap has a first end with a buckle affixed to it and a free end. A loop portion of a hook and loop fastener, such as that commonly sold under the trademark "Velcro," is affixed to the outer surface of a portion of the strap which is attached to the outer surface of the compressible elastomeric strip. A hook portion of the hook and loop fastener is affixed to the outer surface of that portion of the strap which extends past the strap end of the compressible elastomeric strip. Other types of buckles may be used, such as those used for belt buckles. The adjustable collar may be removably secured by a method which includes the steps of pressing an inner face of a compressible elastomeric strip against the desired longitudinal portion of the handle where the collar is to be affixed. The free end of the strap is passed through a ring affixed to the buckle end of the strap and looped back and pulled to tightly compress the elastomeric strip, after which the loop portion and hook portion are pressed together to hold the compressible elastomeric strip in a compressed configuration tightly against the handle. In a preferred version, a portion of loop material is attached to the strap near but preferably slightly removed from the free end over a portion of the hook portion on the exterior surface of the strap. In a preferred process for securing the adjustable handle grip to a bat or other implement, the free end is placed through the ring before the grip is placed over the end of the bat. The strap is looped back over the exterior surface and the portion of loop material is contacted to the hook material near the ring. This forms a large ring which may be easily slipped over the enlarged heel of a hat. Next, the portion of look material is separated from the hook material and the strap and is pulled further through the ring to tighten the strap around the elastomeric strip.

DESCRIPTION OF THE PREFERRED EMBODIMENTS

Figures 1, 2, 3, 4:
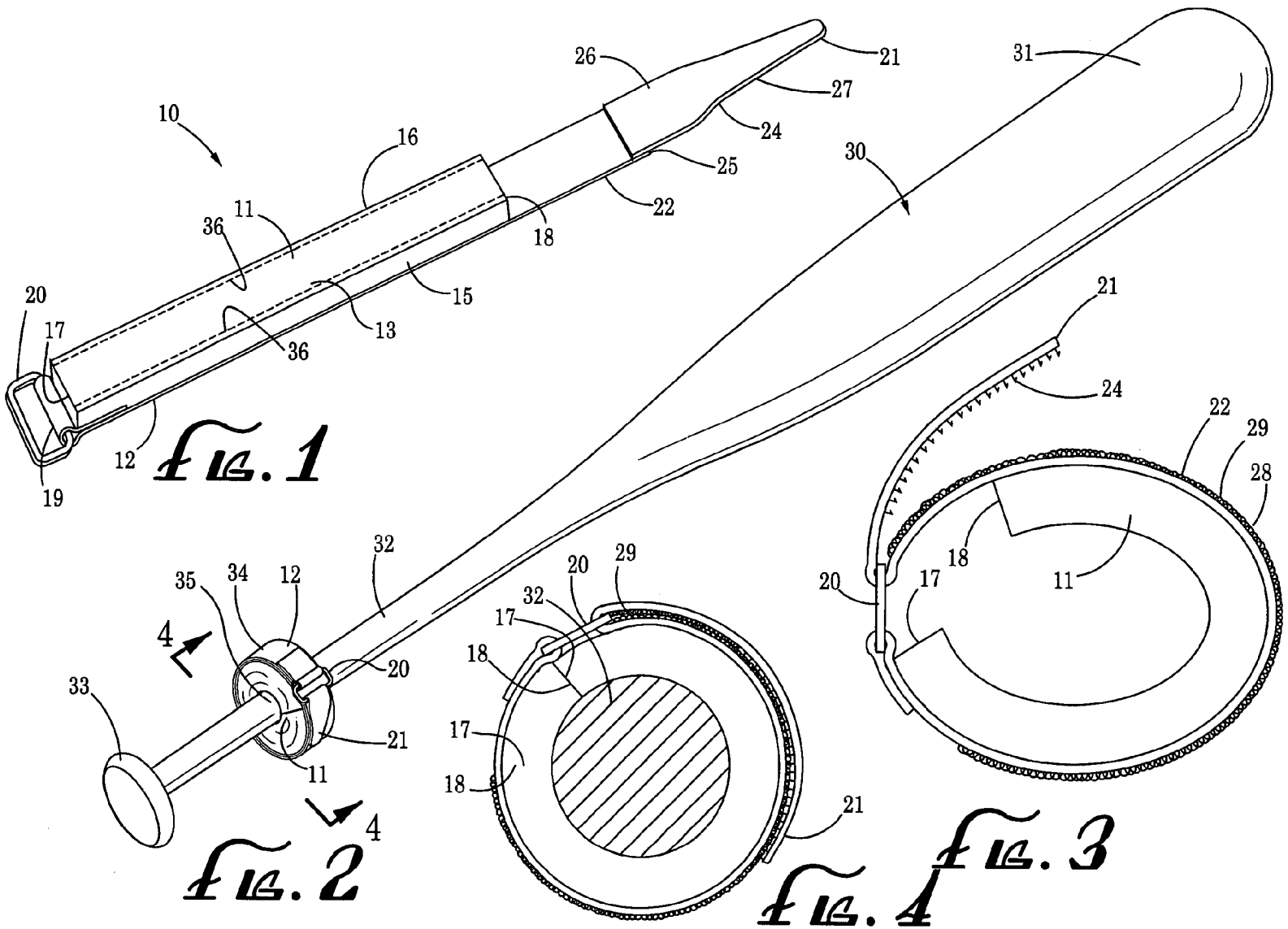
FIG. 1 is a perspective view showing the inner face of the adjustable collar of the present invention.
FIG. 2 is a perspective view showing the collar of FIG. 1 affixed around the handle of a baseball bat.
FIG. 3 is an end view of the adjustable collar of FIG. 1 prior to final tightening.
FIG. 4 is a cross-sectional view taken along line 4—4 of FIG. 2.

The adjustable collar of the present invention is shown in an open configuration in FIG. 1 and indicated by reference character 10. Adjustable collar 10 has a compressible elastomeric strip 11 which is affixed to a strap 12 by any conventional method, such as glue, sewing, rivets, staples, or the like. Preferably, a combination of glue and sewing provides a secure attachment. Sewing at the ends of the elastomeric strip is especially useful. A sewing strip is indicated by reference character 36.

Compressible elastomeric strip 11 has an inner face 13, an outer face 14 which contacts strap 12, a lower edge 15, and an upper edge 16. The faces 17 and 18 can be square, beveled or other shapes, such as curved.

Strap 12 has a first end 19 which has a loop which surrounds and captures a ring 20. The other end of strap 12 is a free end 21 which is configured to pass through ring 20 when the adjustable collar is affixed over a handle. The outer surface of the strap is indicated by reference character 22 and the inner surface of the strap is indicated by reference character 23.

The outer surface of the strap preferably has a hook and loop type fastener of the type commonly sold under the trademark "Velcro." Other fastening devices, such as those used on belts, can be used. As shown best in FIG. 3, the free end 21 of the strap 12 has a hook portion 24 extending back preferably to an intersection 25 shown in FIG. 1. Preferably, this provides an end piece 26 which is fabricated from a length of material which has hook portions extending from its outer surface 27. The outer surface 22 is preferably made from a length of loop portion of the hook and loop fastener. When the free end 21 is looped through ring 20, the hook portion 24 is capable of being affixed anywhere along the loop portion 28. This forms an important feature of the present invention which permits the user to tighten the adjustable collar 10 securely around a number of different sizes of handles. The strap should be pulled sufficiently tight so that it compresses the compressible elastomeric strip 11 and forms a collar which will not move along the handle.

A baseball bat 30 has a barrel portion 31, a handle 32 and a knob 33. The adjustable collar of FIG. 1 is secured to the baseball bat by pressing the inner face 13 of the compressible elastomeric strip against a portion of handle 32 where it is desired to affix the collar. The free end 21 of strap 12 is then looped through ring 20 and pulled back over the compressible elastomeric strip 11. It is pulled back sufficiently far to slightly compress the strip 11 so that a very secure attachment of the resulting stop 34 is made. Even if the bat is wet or the weather cold, the stop 34, when properly affixed to handle 32, will not move from its desired longitudinal portion 35 of handle 32. When it is desired to change the location of the resulting stop 34, this, of course, may be easily done by peeling back the free end 21 and reaffixing at a new desired longitudinal portion.

Preferably, the compressible elastomeric strip is fabricated from an ethylene vinyl acetate (EVA) elastomer or other rubber-type material. Although the elastomeric strip can be slightly wider than strap 12, it is preferred that both the strip 11 and strap 12 be the same width.

Figure 5:
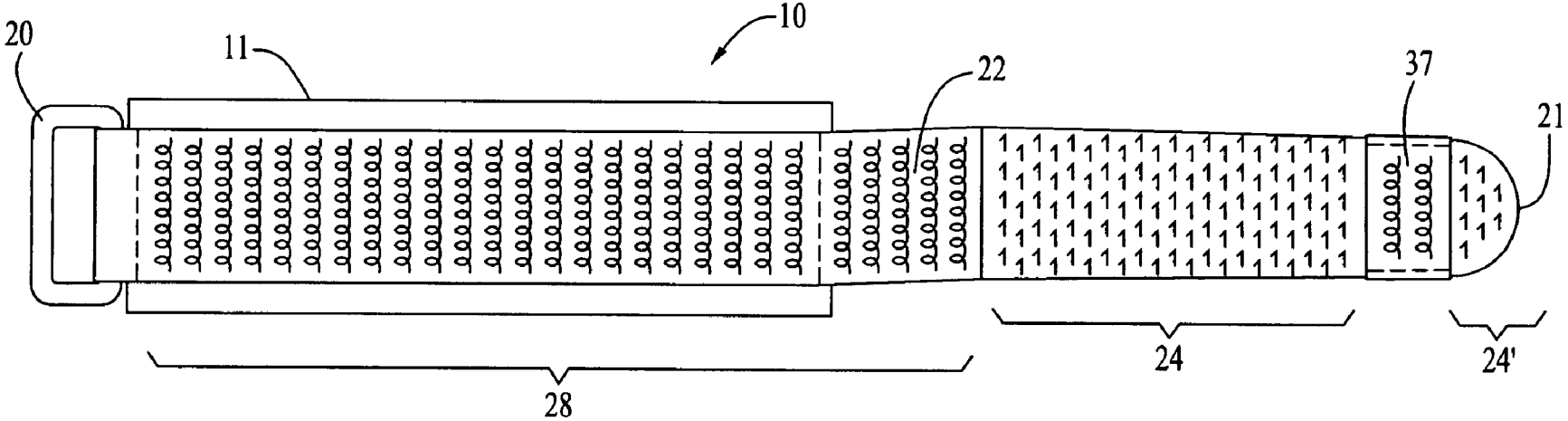
FIG. 5 is a face view of the exterior surface of the strap of the adjustable collar of the present invention.

A preferred strap is shown in FIG. 5 as viewed from the exterior or outer surface 22. The portion 28 has a loop material affixed and the portion 24 has a hook material affixed thereto. A small length or patch of loop material 37 is sewn or otherwise affixed near but preferably slightly removed from the free end 21 of the strap.

Figure 6:
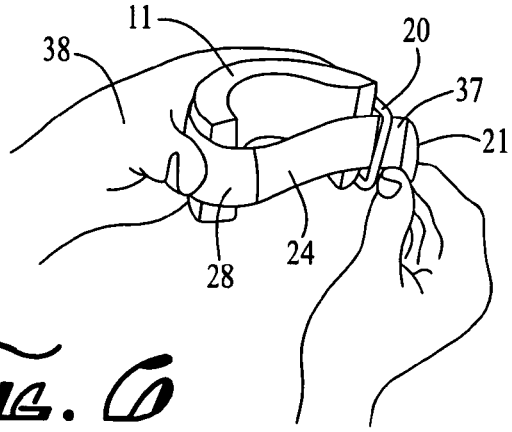
FIG. 6 is a perspective view of a user slipping the free end of the strap through the ring.
Figure 8:
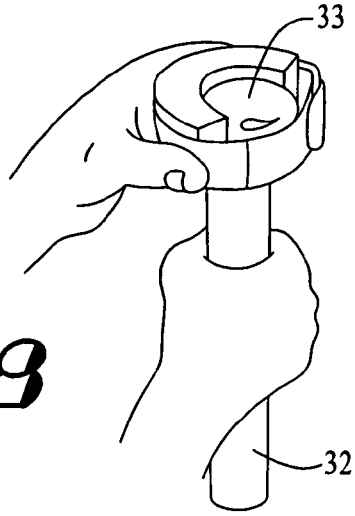
FIG. 8 is a perspective view of the ring of FIG. 7 being slipped over the heel of a bat.

As shown in FIG. 6, a user's left hand 38 is shown bending the elastomeric strip 11 into a curve or arc having passed the free end 21 through ring 20. The loop material 37 is pressed against the hook material 24 near ring 20 to form a ring. The ring is large enough to fit over heel 33 as shown in FIG. 8.

Figure 9:
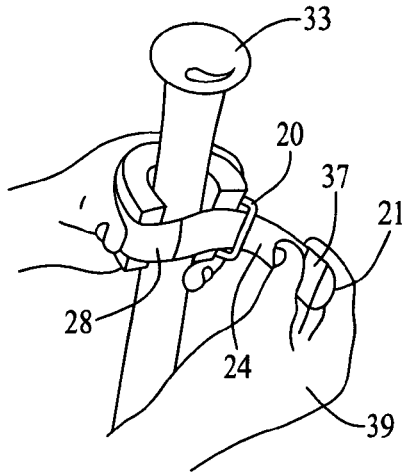
FIG. 9 is a perspective view of the strap being tightened against the bat.
Figure 10:
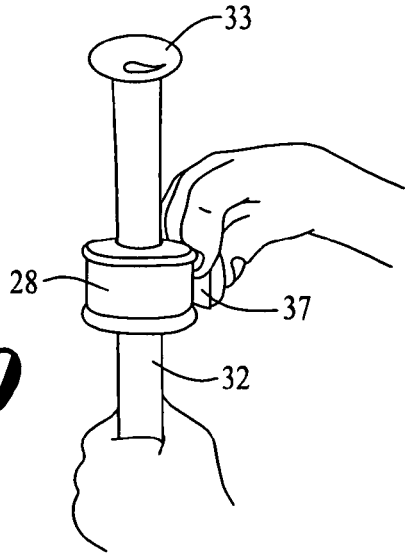
FIG. 10 is a perspective view of the pressing of the free end of the strap around a bat.

Next, as shown in FIG. 9, the free end is gripped b the user's right hand 39 and pulled loose to permit the user to tighten the strap around the bat handle 32. Lastly, the hook portion 24 is pressed against the loop portion 28 to form a secure stop against the bat handle as shown in FIG. 10. The small portion of kook material 24 between the free end 21 and the loop material 37 secures the strap free end 21 against the loop portion 28 to provide a secure appearance.

Figure 7:
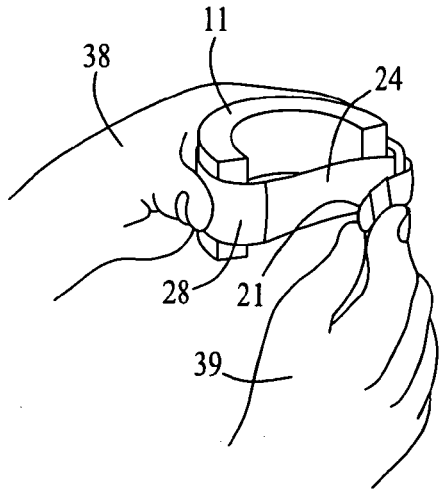
FIG. 7 is a perspective view similar to FIG. 6 but with the free end looped over so that a portion of loop material may contact a portion of the hook material on the exterior surface of the strap to form a ring.

Thus, the presence of the loop portion 37 eliminates the need to form the tight arc shown in FIG. 4 with the user's left hand. For some of the younger players with smaller hands, this can be difficult and this difficulty is eliminated by the ability to form the ring shown in FIG. 7.

While the adjustable collar is shown around the handle of a baseball bat, it can, of course, also be used on a golf club or other implement such as a broom, rake, shovel, or the like, where the desire to removably affix a collar is needed. It has been found that a collar having a width of about 1" is sufficient.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

We claim:

1. An adjustable collar for removable attachment to a handle, said adjustable collar comprising:

a compressible elastomeric strip having an upper edge, a lower edge, a buckle end, a strap end, an inner face and an outer face;

a strap affixed to said outer face of said compressible elastomeric strip, said strap having a first end with a buckle affixed thereto and a free end with an end adapted to fit through said buckle and said first end of said strap extending past said buckle and of said compressible elastomeric strip and said free end of said strap extending past said strap end of said compressible elastomeric strip, said strap having an inner surface in contact with said compressible elastomeric strip and said strap having an outer surface;

a loop portion affixed to said outer surface of said strap positioned over at least a portion of said strap which is affixed to said outer face of said compressible elastomeric strips; and a hook portion affixed to said outer surface of said strap positioned over at least a portion of the outer surface of said strap which extends past the strap end of said compressible elastomeric strip;

a short segment of a loop portion affixed within said hook portion near free end whereby said adjustable collar may be formed into a ring by passing the free end of the strap through the buckle from the direction of the inner surface of the strap, looping the free end back toward the compressible elastomeric strip and pressing the short segment of a loop portion against a portion of the hook portion near said buckle to form a ring and said strap and strip may be removably secured around a handle by placing the ring over an end of said handle, detaching the short segment of a loop portion from the hook portion, pressing the inner face of said compressible elastomeric strip circumferentially around a handle, and pulling the free end tight and pressing the hook portion against the loop portion to secure the strap around the handle.

2. The adjustable collar of claim 1 wherein said short segment of a loop portion is affixed to said inner surface of said strap so that a short length of hook material exists between said short segment of a loop portion and said free end whereby the free end of the strap may be secured against the loop portion of said strap.

3. A method for applying a stop on a handle comprising:

forming a loop from a strap having an inner surface, an outer surface a buckle end and a free end, a ring affixed to said buckle end and a length of a first of a hook and loop attachment material affixed along a portion of said outer surface between said buckle end and said free end, a length of a second of a hook and loop attachment material affixed along a portion of said outer surface between said free end and said first of said hook and loop attachment material, a short length of said first of said hook and loop material affixed to said interior surface of said strap near said free end and a compressible elastomeric strip affixed along a portion of said inner surface of said strap extending from a position near said buckle end and terminating to leave a free length of strap, said loop being formed by passing said free end of said strap through said ring from an inner surface thereof and pressing the short length of said first of said hook and loop material against said portion of said second of said hook and loop material thereby forming a loop;

placing said loop over an end of a handle;

pressing an inner face of said compressible elastomeric strip against the desired longitudinal position of said handle where said stop is to be applied, removing the short length of said first of said hook and loop material from said second of said hook and loop material and pulling the free end tight an amount to compress the compressible elastomeric strip and pressing the hook portion against the loop portion to secure a resulting collar around the handle.

* * * * *